United States Patent [19]

Suga

[11] 4,114,067

[45] Sep. 12, 1978

[54] ELECTRODE OPERATING MECHANISM FOR CARBON ARC LAMP

[76] Inventor: Shigeru Suga, Yoyogi 5-20-2, Shibuya-ku, Tokyo, Japan

[21] Appl. No.: 805,577

[22] Filed: Jun. 10, 1977

[30] Foreign Application Priority Data

Dec. 14, 1976 [JP] Japan ..... 51-168058

[51] Int. Cl.[2] ..... H05B 31/20; H05B 31/48

[52] U.S. Cl. ..... 314/134; 314/68; 314/56

[58] Field of Search ..... 314/51, 53, 56, 68, 314/134, 130; 13/14–17, 13; 362/210; 313/147

[56] References Cited

U.S. PATENT DOCUMENTS

| | | | |
|---|---|---|---|
| 576,802 | 2/1897 | Baurlin | 314/56 X |
| 728,902 | 5/1903 | Girdlestone et al. | 314/56 X |
| 801,637 | 10/1905 | Batault | 314/56 X |
| 3,046,437 | 7/1962 | Kuppens | 314/51 |

*Primary Examiner*—R. N. Envall, Jr.
*Attorney, Agent, or Firm*—Wenderoth, Lind & Ponack

[57] ABSTRACT

An improved electrode operating mechanism for control of the discharge of carbon arc lamps for light fastness testing devices. Vertically spaced upper and lower electrode holders have a plurality of electrodes opposed to each other. Two vertical supports extend between upper and lower bases, the vertical supports each having a pair of spaced parallel guide rails extending therealong, each holder having laterally projecting arm members extending from the opposite ends thereof and between the rails. A cylindrical slide member is mounted on the end of each arm member and is slidably engaged in linear sliding contact with the surface of the parallel rails on the sides thereof away from the holders. First wires are attached to the cylindrical slide members on the lower electrode holders and extend upwardly through the upper base through axial bores in the upper cylindrical slide member, and two second wires attached to the upper holders extend upwardly through the upper base. The first wires are wound in one direction around two pulleys on a horizontal shaft on the upper base and the second wires are wound in the opposite direction around other pulleys on the shaft. When the shaft is rotated in one direction the electrodes are moved toward each other and when the shaft is rotated in the opposite direction the electrodes are moved away from each other.

3 Claims, 5 Drawing Figures

ELECTRODE OPERATING MECHANISM FOR CARBON ARC LAMP

This invention relates to improvements in an electrode operating mechanism for control of the discharge carbon arc lamps used for light fastness testing devices or the like, and it is intended to operate so as to minimize the attachment of ash produced due to burning of carbon electrodes during discharge to the operating mechanism and also to permit correct operation of each mechanism to be maintained and prevent operating difficulties even if some ash does become attached to the operating mechanism.

BACKGROUND OF THE INVENTION AND PRIOR ART

The usual prior-art carbon arc lamp and the electrode operating mechanism thereof have a structure as shown in FIG. 1. Upper carbon electrodes 1 and lower carbon electrodes 2 are mounted on an upper electrode holder 3 and a lower electrode holder 4, respectively. The electrodes and electrode holders within a glass housing 7 between an upper base 5 and a lower base 6. A drive section 8 is mounted on the upper base 5. The electrode holders 3 and 4 are coupled together by chains 9 extending over sprockets D and are vertically moved by the rotation of sprockets 10 by a motor 10*a* through bevel gears 10*b*. Slide members 11 and 11' move vertically along two upright supports 12 extending between and secured to upper and lower bases for guiding the electrode holders 3 and 4.

In this arrangement, the upright supports 12 and slide members 11 and 11' are subject to staining by the ash produced from the electrodes 1 and 2 during their discharge, and as ash gathers in the gap between the slide members 11 and 11' and the associated upright supports 12, the friction is increased. The accumulated ash is likely to become a solid mass and eventually cause the parts to stick, thus stopping the movement of the holders.

Accordingly, a large gap must be provided between each of the slide members and the associated upright support so that the sliding movement will not be prevented. Even with this arrangement, however, an undesired result cannot be completely prevented when the apparatus is used for a long period of time. In addition, because of the presence of the gap, the center position of the electrodes is subject to a shifting to a corresponding amount, causing a deviation from the alignment of opposed upper and lower electrodes and giving rise to abnormal discharge. Further, since chains are used to move the electrodes, blocking of the movement of the electrode holders is also likely to be caused by ash adhering to the chains and preventing of the normal functioning thereof.

OBJECT AND BRIEF SUMMARY OF THE INVENTION

The present invention has as its object the elimination of the above drawbacks, and to this end use is made of wires for coupling the electrode holders and grooved wheels on the drive shaft, and also the upright supports for the electrode holders are made channel-shaped and are each provided on the side thereof facing away from the electrodes with two guide rails consisting of round rods for linear contact with associated cylindrical slide members. By these improvements, the gap between the relatively movable parts which existed in the prior art has been eliminated so as to ensure that the electrodes always assume correct position during their vertical movement which in turn ensures normal and correct interelectrode discharge.

BRIEF EXPLANATION OF THE DRAWINGS

The invention will now be described in connection with the accompanying drawings, in which.

DETAILED DESCRIPTION OF THE INVENTION

Figure 1:
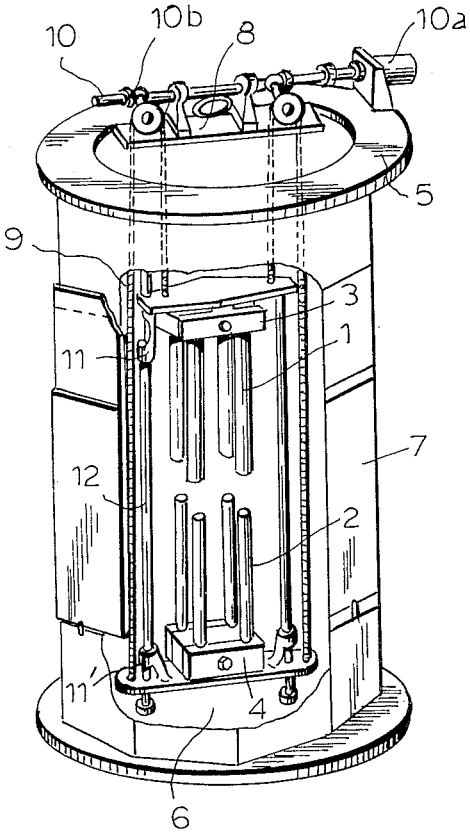
FIG. 1 is a perspective view of a prior-art carbon arc lamp.

As shown in FIGS. 2 to 5, the electrode operating mechanism according to the present invention has upper and lower carbon electrodes 13 and 14, upper and lower bases 15 and 16 secured in spaced relationship by rods 41, a motor 17 mounted on upper base 15, leads 18 and 19 for connecting the upper and lower electrodes to an electric circuit, and a glass housing (not shown in FIGS. 2 to 5) through which the light passes and the electric circuit are the same as in the prior art apparatus.

In the improved operating mechanism according to the invention, slotted upright supports 28 are mounted between mounting pieces 26 and 27 secured on the upper and lower bases 15 and 16 by bolts 27*a* and 26*a* with the open side of the supports directed outwardly of the electrode holders. Each upright support is provided with guide rails 29 consisting of round rods secured to opposite corners thereof by screws or bolts 45 described below. The upright supports 28 have vertical slots 43 therein.

Figure 5:
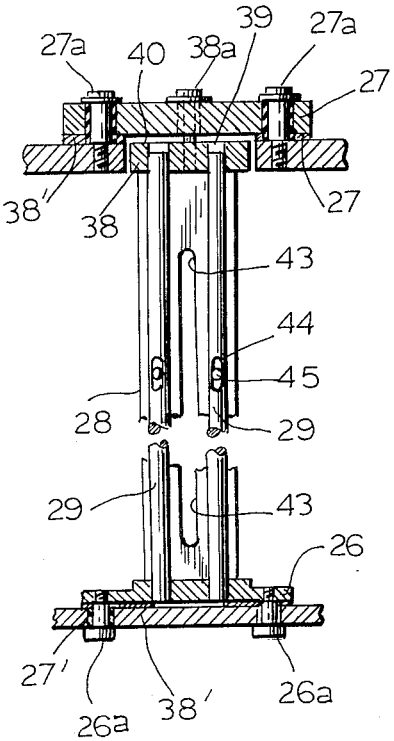
FIG. 5 is a broken sectional elevation view illustrating the manner of securing the guide rails to the bases.
Figure 2:
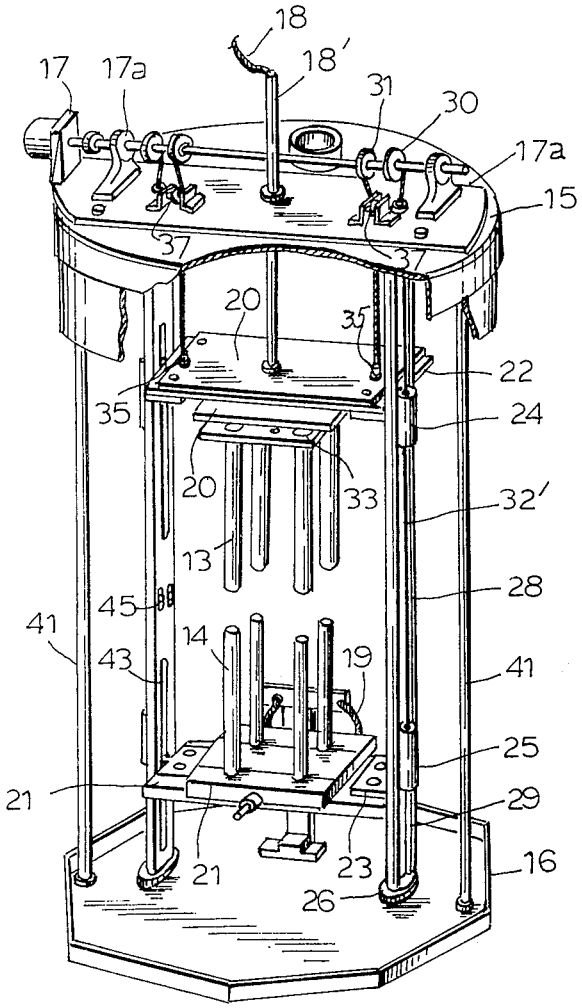
FIG. 2 is a perspective view of a carbon arc lamp having an electrode operating mechanism according to the invention.
Figure 4:
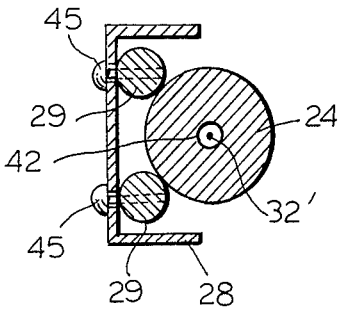
FIG. 4 is an enlarged sectional view of the relatively movable parts of the lamp of FIG. 2.
Figure 3:
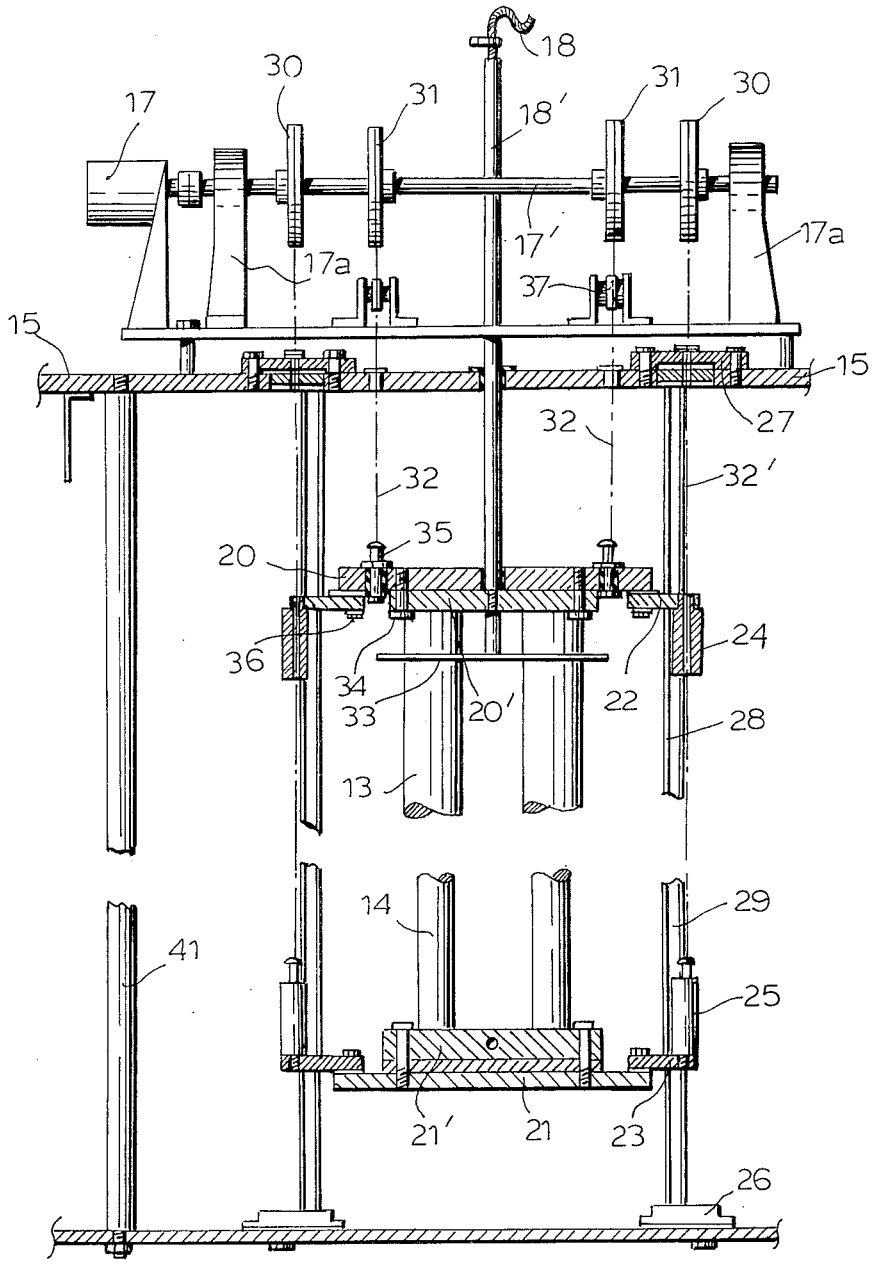
FIG. 3 is a broken sectional elevation view of the lamp of FIG. 2.

As shown in FIG. 5, an upper mounting means for the guide rails 29 consists of two members, namely a disc 38 having holes 39' receiving the ends of respective guide rails and the mounting piece 27 having the disc 38 attached thereto by bolt 38*a* and mounted on the base 15. The mounting piece 27 is insulated from upper base 15 by insulating bushings 27' and washers 38.

The lower mounting means is constituted by a mounting piece 26.

The base 16 and mounting piece 26 are also electrically insulated from each other by an insulating bushing 27 and washers 38'.

The guide rails 29 and upright support 28 have a length slightly less than the distance between the upper and lower mounting pieces 27 and 26, and the guide rails 29 are slidably inserted in the holes 39' formed in the disc 38 and holes 26' formed in the mounting piece 26. A gap is provided between the disc 38 and mounting piece 27.

The securement of the slotted upright support 28 to guide rails 29 is by means of stepped screws 45 each screwed into a threaded hole formed in the respective guide rail 29 and passed through a corresponding slot 44 formed in the upright support 28. This method of securement and the provision of the gap ensures that the guide rails 29 and upright support 28 will not deform due to thermal expansion and contraction with temperature changes thereof.

The upper carbon electrodes 13 are mounted on a holder plate 20'. A protective plate 33 is mounted on holder plate 20'. The holder 20' is secured by screws 34 to an upper holder 20. An electric conductor 18' extends upwardly from the center of the holder plate 20', and serves to electrically couple the carbon electrodes 13 to the lead 18 and thence to the electric circuit. The upper holder 20 is provided with hook pieces 35, to which wires 32 are connected, and which are electrically insulated from the holder 20. The upper holder 20 is provided at its opposite ends with arm members 22 electrically insulated from upper holder 20 and secured to it by bolts 36. The arm members 22 extend through the slots 43 in the respective upright supports 28 and are provided at their tip with respective cylindrical slide members 24, the periphery of each slide member 24 being in sliding contact with two associated guide rails 29, as most clearly shown in FIG. 4. The upper slide members 24 each have a central axial hole 42, through which a further wire 32' extends. The size of the hole 42 is selected such that the wires 32' will not touch the hole in its vertical movement.

The lower electrodes 14 are mounted on a holder plate 21' by a conventional method (i.e., by means of screws tightened via a mounting member). Similar to the upper holder the lower holder 21' has arms 23 with slide members 25 thereon movable along the guide rails 29. Each of the slide members 25, however, has a further wire 32 connected to the top thereof. The upper end of each wire 32 is passed through the hole 42 in the associated upper slide member 24 and coupled to a corresponding grooved wheel 30 on shaft 17' mounted in bearings **17*a* and connected to motor 17. The other end of each wire 32 for the upper holder 20 is passed round an associated pulley 37 in the drive section to change its direction and is coupled to an associated grooved wheel 31 on shaft 17'. Thus, the wires 32 and 32' are adapted to be wound up and unwound from the pulleys 30 and 31. During unwinding, the holders 20 and 21 are lowered by their own weight. The four wires extend parallel to one another. However, wires 32' are passed round the grooved wheels 30 in the opposite direction to that in which wires 32 are passed round the grooved wheels 31, so that upon rotation of the motor 17 in one direction, the upper and lower holders 20 and 21 are moved in opposite directions, i.e., when the upper holder 20 is raised, the lower holder 21** is lowered, and vice versa.

Since the guide rails 29 are provided on the side of the upright support 28 opposite to the electrodes 13 and 14 and the slide members 24 and 25 are protected by the upright supports 28, they are not directly subject to the spattering of ash from the electrodes 13 and 14 and, hence, very little ash is attached thereto. Further, because the guide rails 29 are not deformed due to temperature changes as described, very little ash is attached thereto, the play (dimensional tolerances) in the frictional parts can be made very small, so that it is possible to obtain accurate vertical movement of the electrodes with little or no oscillation.

Further, since the frictional parts are in line contact, they are not prone to collect ash. Even if ash becomes attached to these parts, cleaning can be accomplished very easily.

The carbon arc lamp for a light-fastness testing device should be turned on continuously, for instance, for 60 hours with a discharge provided by power of, for instance, 50 V and 60 A. To maintain this 50-V 60-A discharge, the motor is controlled for forward or reverse rotation by means of a servo amplifier (not shown) by comparison of the discharge current with a reference current of 60 A in the electric circuit to thereby control the interelectrode distance between the upper and lower carbon electrodes by the electrode operating mechanism described above. Since the testing of samples generally takes a period in excess of 500 hours, a very great quantity of ash is produced.

Tests conducted by the mechanism according to the invention have proved that it is less prone to attachment of ash as compared with the prior art devices and no troubles occur.

What is claimed is:

1. An improved electrode operating mechanism for control of the discharge of carbon arc lamps for light fastness testing devices, comprising an upper electrode holder means and a lower electrode holder means vertically spaced from each other, a plurality of electrodes on each holder means projecting toward each other with the ends of corresponding electrodes opposed to each other, an upper base and a lower base vertically spaced from each other with said holder means being between said bases, two vertical support means extending between said upper and lower bases, said vertical support means each having a pair of spaced parallel guide rails extending therealong, each holder means having laterally projecting arm members extending from the opposite ends thereof and between said rails, a cylindrical slide member mounted on the end of each arm member and slidably engaged in linear sliding contact with the surface of said parallel rails on the sides thereof away from the holder means, a first wire attached to the cylindrical slide member at each end of said lower electrode holder means and extending upwardly through said upper base, said cylindrical slide members on said arms on said upper base having axial bores therethrough through which said first wires freely pass, two second wires attached to said upper holder means and extending upwardly through said upper base, a horizontal shaft rotatably mounted on said upper base and having a pulley thereon for each of said wires, the first wires being wound in one direction around two of the pulleys and the second wires being wound in the opposite direction around the other pulleys, whereby when the shaft is rotated in one direction the electrodes are moved toward each other and when the shaft is rotated in the opposite direction the electrodes are moved away from each other.

2. An improved electrode operating mechanism as claimed in claim 1 in which said vertical support means further have a channel-shaped member with the channel directed away from the holder means and having an elongated slot in the protion toward said holder means through which said arm member extends, said rails being positioned in said channel shaped member on opposite sides of said slot, whereby the rails are protected from the heat generated by the discharge across said electrodes.

3. An improved electrode operating mechanism as claimed in claim 1 in which said vertical support means is connected to said upper for permitting relative movement of said rails vertically relative to said upper base to permit expansion and contraction of said rails relative to said upper base.

* * * * *